US005742267A

United States Patent [19]

Wilkinson

[11] Patent Number: 5,742,267

[45] Date of Patent: Apr. 21, 1998

[54] CAPACITIVE CHARGE DRIVER CIRCUIT FOR FLAT PANEL DISPLAY

[75] Inventor: Dean Wilkinson, Boise, Id.

[73] Assignee: Micron Display Technology, Inc., Boise, Id.

[21] Appl. No.: 583,565

[22] Filed: Jan. 5, 1996

[51] Int. Cl.[6] ..... G09G 3/30

[52] U.S. Cl. ..... 345/77; 345/74

[58] Field of Search ..... 345/74–77, 84, 345/91, 205, 206

[56] References Cited

U.S. PATENT DOCUMENTS

| | | | |
|---|---|---|---|
| 4,654,649 | 3/1987 | Kojima et al. | 345/205 |
| 5,210,472 | 5/1993 | Casper et al. | 315/349 |
| 5,212,426 | 5/1993 | Kane | 315/169.1 |
| 5,300,862 | 4/1994 | Parker et al. | 345/76 |
| 5,469,026 | 11/1995 | Madsen | 345/75 |

OTHER PUBLICATIONS

Yaniv et al., "A New Amorphous–Silicon Alloy Pin Liquid–Crystal TV Display," *SID International Symposium Digest of Technical Papers*, New York, May 1986, pp. 278–280.

Vijan et al., "High–Performance Amorphous–Silicon Alloy PIN Active–Matrix LCD for Military and Avionic Applications," *SID International Symposium Digest of Technical Papers*, New York, 1987, pp. 159–160.

*Primary Examiner*—Richard Hjerpe
*Assistant Examiner*—Vui T. Tran
*Attorney, Agent, or Firm*—Seed and Berry LLP

[57] ABSTRACT

A driver circuit for driving the emitters of a flat panel display such as a field emission display. The driver circuit includes a capacitor and a charge circuit. The capacitor is connected between the emitter and an extraction grid held at a constant potential. The charge circuit has two inputs respectively connected to a row line and a column line. The charge circuit also has a charge terminal connected to the capacitor. In operation, the charge circuit applies at the charge terminal a selected voltage level which is below the grid voltage. The selected voltage level represents the intensity of the pixel associated with the emitter. In response to the selected voltage level at the charge terminal, the extraction grid charges the capacitor to a potential which is the difference between the grid voltage and the selected voltage level. When charged, the capacitor is isolated from the driver circuit. The charge stored in the isolated capacitor discharges through the emitter. In a preferred embodiment of the invention, the charge circuit includes a pair of diodes that drive the emitter. Because diodes are much easier to fabricate than transistors and they exhibit very stable and reproducible electrical characteristics, the driver circuit provides the advantages of low cost, high manufacturing yield and high reliability.

21 Claims, 2 Drawing Sheets

CAPACITIVE CHARGE DRIVER CIRCUIT FOR FLAT PANEL DISPLAY

TECHNICAL FIELD

This invention relates to flat panel displays, and more particularly, to a driver circuit for driving a flat panel display.

BACKGROUND OF THE INVENTION

Flat panel displays are widely used in a variety of applications, including computer displays. One type of flat panel displays is the field emission display.

Field emission displays typically include a generally flat emitting panel behind a display screen. The emitting panel includes a substrate having an array of conical projections known as emitters integrated in the substrate. Each pixel (picture element) of the display includes multiple emitters having a common base. The number of emitters per pixel depends on the size and resolution of the display. In a small display of 0.7 inches having a resolution of 420×240 pixels, for example, there may be 5 to 10 emitters per pixel. In a large display of 14 inches having a resolution of 1024×1024 pixels, there may be 200 to 250 emitters per pixel. A conductive extraction grid is positioned between the display screen and the emitters, and is driven with a voltage of about 30V–120V relative to the emitter voltage. An emitter set corresponding to one pixel is then selectively activated by a driver circuit to produce an electric field extending from the extraction grid to the emitters. In response to the electric field, the emitter set emits electrons.

The display screen mounted directly above the extraction grid is coated with a transparent conductive material to form an anode biased to about 1–2 kV (kilovolts). The anode attracts the emitted electrons, causing the electrons to pass through the extraction grid. A cathodoluminescent layer covers a surface of the anode facing the extraction grid to intercept the electrons as they travel toward the 1–2 kV potential of the anode. The electrons striking the cathodoluminescent layer cause the cathodoluminescent layer to emit light at the impact site. The emitted light is visible to a viewer of the display screen.

The brightness or intensity of the light produced in response to the emitted electrons depends, in part, on the rate at which the emitted electrons strike the cathodoluminescent layer, which in turn depends upon the amount of current available to provide the electrons to the emitter sets. An appropriate driver circuit controls the brightness of each pixel by selectively varying the current flow to the respective emitter set.

There are many well-known driver circuits for driving the field emission display. A detailed operation of one type of driver circuits is, for example, described in U.S. Pat. No. 5,210,472 to Casper et al. and assigned to Micron Technology, Inc. of Boise, Id. FIG. 1 represents one of the driver circuits disclosed in the Casper patent. The field emission display 2 is characterized by a conductive extraction grid 4 held at a constant voltage Vgrid sufficient to cause electrons to be emitted by the emitters 6. Each pixel includes multiple emitters 6A–6C connected to a common base electrode 8. The driver circuit comprises a pair of transistors 10 and 12 connected in series between the base electrode 8 and ground. The gate of the transistor 10 is connected to a column line C while the gate of the transistor 12 is connected to a row line R. Normally, the transistors 10 and 12 are off and the emitters 6A–6C are in a non-emitting state. When the pixel is addressed, a logic high voltage is applied to the gate of the transistor 12 to enable the row line. Shortly thereafter, a positive analog voltage corresponding to the brightness of the pixel is applied to the gate of the transistor 10.

For large field emission displays of 6 inches or greater, the driving transistors 10 and 12 are generally formed on a glass substrate as thin film transistors (TFT). One major disadvantage of TFTs is that they are very difficult to manufacture. Because even one defective transistor forces a manufacturer to throw away the display, TFT displays suffer from a low manufacturing yield and thus, are very expensive. Another disadvantage of the TFTs is that they are relatively unreliable. For example, the junction between the gate and source of the TFTs tends to short out rendering the corresponding pixel inoperative. Moreover, the transistors suffer from instability in threshold voltage levels.

Therefore, it is desirable to provide a highly reliable driver circuit for flat panel displays that can be produced with a relatively high yield.

SUMMARY OF THE INVENTION

According to the principles of the present invention, a driver circuit for driving the emitters of a flat panel display such as a field emission display is provided. The driver circuit includes a capacitor and a charge circuit. The capacitor is connected between the emitters and an extraction grid held at a constant potential. The charge circuit has two inputs respectively connected to a row line and a column line. The charge circuit also has a charge terminal connected to the capacitor. In operation, the charge circuit applies at the charge terminal a selected voltage level which is below the grid voltage. The selected voltage level represents the intensity of the pixel associated with the emitters. In response to the selected voltage level at the charge terminal, the extraction grid charges the capacitor to a potential which is the difference between the grid voltage and the selected voltage level. When charged, the capacitor is isolated from the driver circuit. The charge stored in the isolated capacitor then discharges through the emitter.

In a preferred embodiment of the invention, the charge circuit includes a pair of diodes to drive the emitter. Because diodes are much easier to fabricate than transistors and they exhibit very stable and reproducible electrical characteristics, the driver circuit according to the invention provides the advantages of low cost, high manufacturing yield and high reliability.

DETAILED DESCRIPTION OF THE INVENTION

Figure 1:
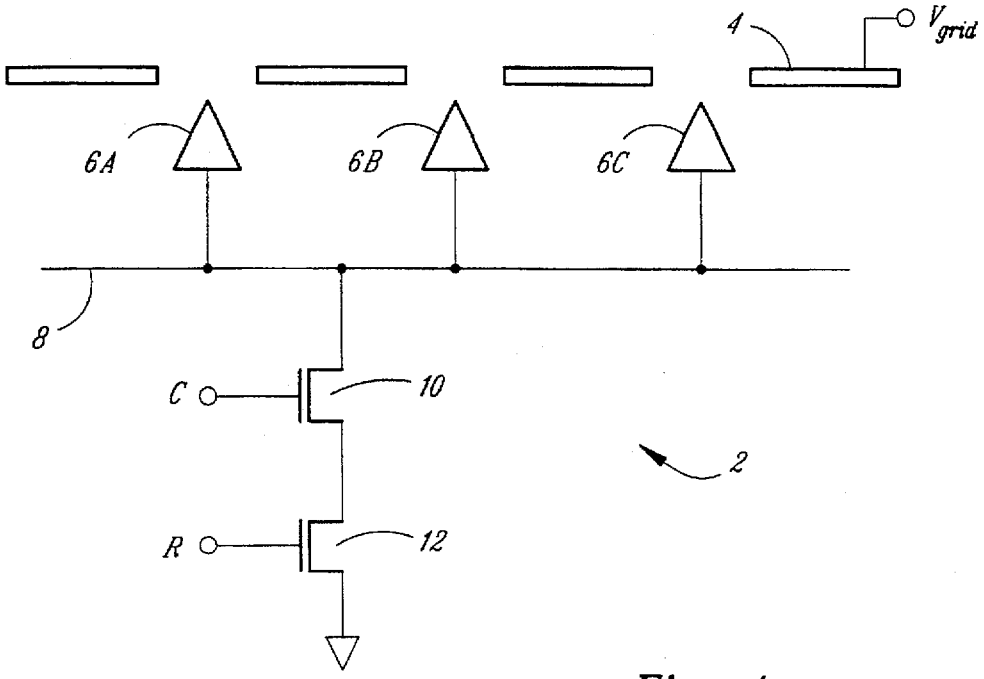
Fig. 1 (Prior Art)
FIG. 1 is a schematic diagram of a prior art field emission display connected to a prior art driver circuit.
Figure 2:
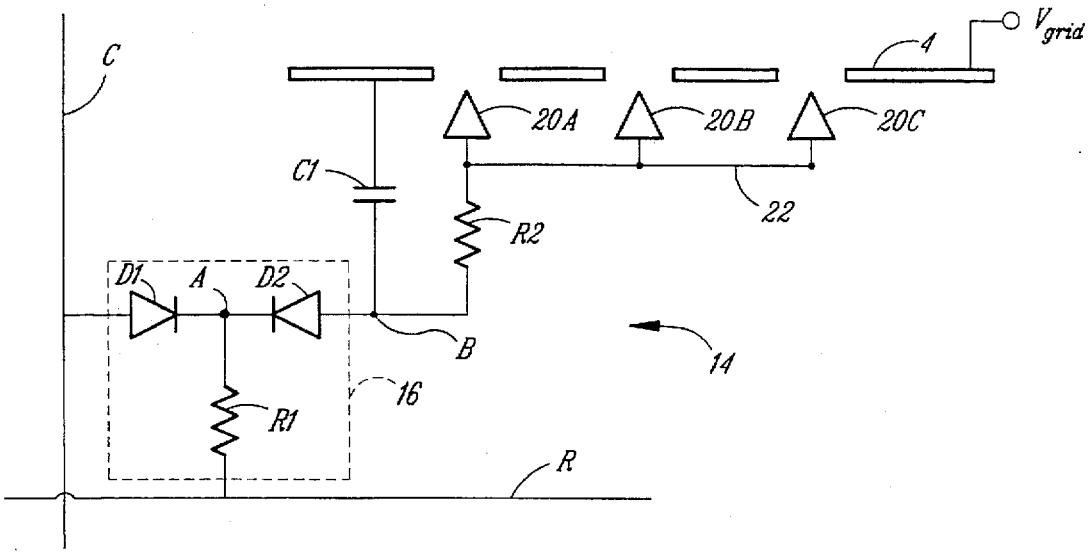
FIG. 2 is a schematic diagram of a driver circuit for a field emission display according to the present invention.

FIG. 2 is a schematic diagram of the driver circuit 14 for a field emission display according to the present invention. As in FIG. 1, the field emission display is characterized by a conductive extraction grid 4 held at a grid voltage Vgrid, and an emitter set 20A–20C having a common base electrode 22. A capacitor C1 and resistor R2 are connected in series between the extraction grid 4 and the emitter set 20A–20C. The emitter set 20A–20C represents one pixel of the field emission display. Diodes D1 and D2, and a resistor R1 comprise a charge circuit 16 according to the invention. The diodes are preferably of amorphous silicon alloy PIN (P type-Insulator-N type) type having a low leakage current and relatively high reverse-bias breakdown voltage. The diode D1 is connected between a column line C and node A while the diode D2 is connected between node B and node A. The resistor R1 is connected between the row line R and node A. A detailed operation of the driver circuit will now be described. For clarity in describing the driver circuit 14 of FIG. 2, assume that the extraction grid is held at the grid voltage Vgrid of 100 volts, the emission threshold voltage of the emitters 20A–20C is –40 volts relative to the grid potential Vgrid, and the threshold voltage of the diodes D1–D2 is 2 volts.

When the pixel corresponding to the emitter set 20A–20C is not being selected or addressed, the row line R is held at a voltage between 58 volts and 100 volts relative to ground. During the non-selection period, the voltage at node B is lower than that of the row line R as will be explained later herein. This causes the diode D2 to be reverse biased, thereby isolating the capacitor C1 from the row and column lines. The isolated capacitor C1 discharges through the resistor R2 until the voltage across the capacitor C1 is just below the emission threshold voltage of –40 volts (relative to the voltage on the extraction grid 4). During the discharge, the emitter set 20A–20C emits the discharged electrons towards a cathodoluminescent layer of a display screen (not shown). When the emission stops, the voltage at node B is at approximately 60 volts relative to ground and –40 volts relative to the grid potential Vgrid. During the non-selection period, the voltage on the column line C varies between zero volts and the non-selected voltage of the row line R. Because the column line C is at lower potential than the row line R1, the diode D1 is also in a reverse-biased state to prevent any current flow between the row line R and the column line C during the non-selection period.

When the pixel is selected or addressed, the row line R is pulled down to ground and causes both diodes D1 and D2 to be forward-biased. While the row line R is held at ground, the column line C is set to a voltage level between 0 and 58 volts. The column line voltage corresponds to the desired intensity level or gray scale level of the selected pixel with an increase in the column line voltage representing a decrease in the intensity level. For example, 0 volts represents the highest intensity level while 58 volts represents the lowest intensity level (no emission of electrons) for the pixel. Assume now that 10 volts, representing a relatively high intensity level, is applied at the column line C and coupled through the resistor R1 and the diode D1 to the node A. Under these circumstances, the voltage at node A is equal to 8 volts (the column line voltage less the threshold voltage of the diode D1), and the voltage at node B is equal to 10 volts (the voltage at node A plus the threshold voltage of the diode D2). Thus, the 10 volts at the column line C is effectively transferred to node B. The 10 volts at node B causes the capacitor to charge to a potential of 90 volts. Thereafter, the charge stored in the capacitor C1 is latched by raising the voltage of the row line R to the previously unselected level of at least 58 volts. The rise in the row line voltage reverse biases the diodes D1 and D2. The charge stored in the capacitor C1 discharges through the resistor R2 and the emitters 20 until node B reaches slightly below 40 volts relative to the grid voltage Vgrid, which is the emission threshold voltage of the emitters 20. Preferably, the values of C1 and R2 are chosen such that node B reaches the emission threshold voltage relative to the grid voltage Vgrid just as the pixel is being addressed in the next frame scan. Consequently, a transition from maximum to minimum, or minimum to maximum gray scale level occurs in one frame time. Moreover, because the emission period of the emitters for a given pixel is spread over one entire frame time, the driver circuit 14 provides an additional advantage. Specifically, the total energy output is relatively immune from variations in the electrical characteristics of the emitters. By contrast, the prior art driver circuits activate the emitters of a given pixel only when the pixel is addressed. This causes the total energy output to the display screen to be highly dependent on the electrical characteristics of the emitters.

In another aspect of the invention, each diode in the charge circuit 16 may be replaced with multiple diodes to further improve manufacturing yield. For example, each diode D1 and D2 may be replaced with multiple diodes connected in series with each other. Since the most common failure of a diode during the fabrication process is a short across the P/N junction, having multiple diodes prevents one diode failure from rendering the respective pixel inoperative.

Figure 3:
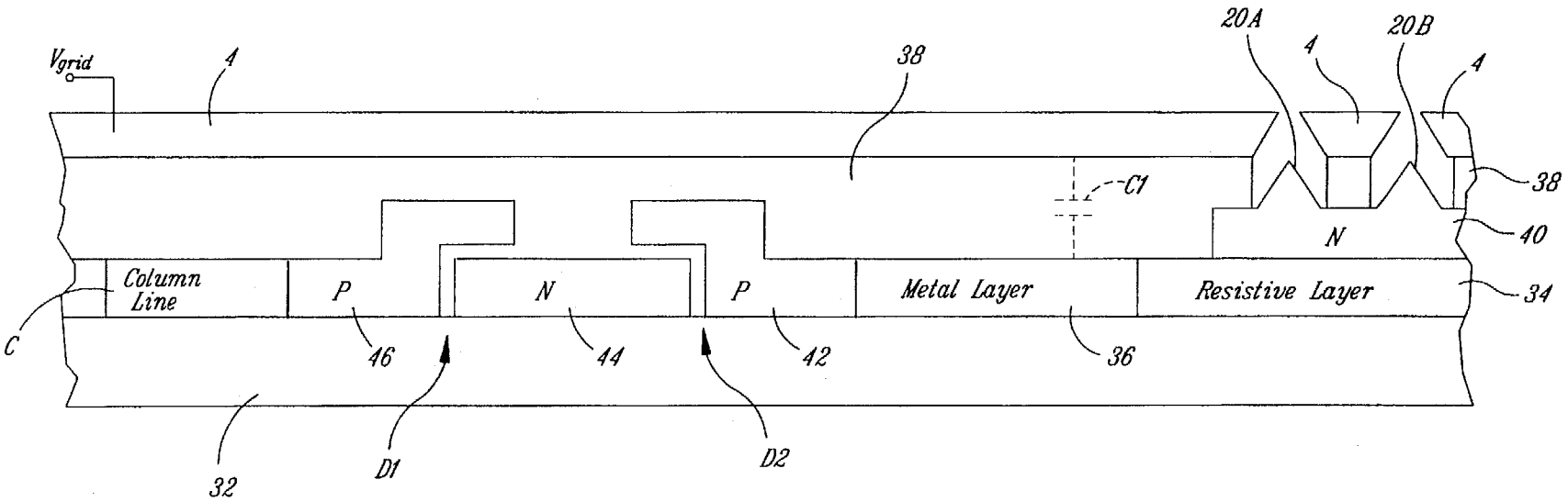
FIG. 3 is a cross-sectional diagram of the driver circuit of FIG. 2.

FIG. 3 is a cross-sectional diagram of the driver circuit 14 of FIG. 2. As shown in FIG. 3, the driver circuit and the emitters 20A–20B are formed on a substrate 32. In a preferred embodiment, the substrate is of a glass type. However, many other types of substrates such as silicon substrate may also be used instead. A conductive extraction grid 4 is formed over an insulating layer 38 and is held at a grid potential Vgrid in operation. The emitters 20A–20B having a common base 40 of N-type semiconductor material are positioned underneath the extraction grid 4. A resistive layer 34 is formed between the base 40 of the emitters 20 and the substrate 32. The resistive layer 34 is equivalent to the resistor R2 of FIG. 2. The capacitor C1 is formed by a metal layer 36, the extraction grid 4 and the insulating layer 38 therebetween. The diode D2 is formed by a P-type region 42, N-type region 44 and insulating layer 38 therebetween. Similarly, the diode D1 is formed by a P-type region 46, N-type region 44 and insulating layer 38 therebetween. As can be seen, the two diodes D1 and D2 share a common cathode 44. Finally, a conductive column line C formed on the substrate 32 is coupled to the diode D1. The resistor R1 and row line R are not shown because they are positioned either in front of or behind the N-type region 44 in this embodiment.

The foregoing specific embodiments represent just some of the ways of practicing the present invention. Many other embodiments are possible within the spirit of the invention. For example, although the driver circuit according to the present invention is described with reference to field emission displays, it may be used in any matrix addressable displays such as electroluminescent or plasma type displays in which high pixel activation voltages are needed. Also, although the capacitor C1 is shown as being connected between the emitters 20 and the extraction grid 4, it will be understood that the capacitor C1 may be connected between the emitters 20 and any other node. Further, although the charge on the capacitor is shown as being adjusted by varying the voltage on the emitter while keeping the voltage on the other plate of the capacitor constant, it will be appreciated that the charge may also be adjusted by keeping the voltage on the emitter constant at some time and then varying the voltage on the other plate of the capacitor. Accordingly, the scope of the invention is not limited to the foregoing specification, but instead is given by the appended claims along with their full range of equivalents.

I claim:

1. A driver circuit for driving the emitter in a flat panel display, comprising:

a capacitor coupled to the emitter; and a charge circuit having an intensity control terminal adapted to receive an intensity control signal and an enable terminal adapted to receive an enable signal, the charge circuit including a first unidirectional current device coupled between the intensity control terminal and a circuit node to which the enable terminal is coupled, and a second unidirectional current device coupled between the circuit node and the capacitor, the first unidirectional current device allowing current to flow responsive to a predetermined relationship between the magnitude of the intensity control signal and the magnitude of a voltage on the circuit node, the second unidirectional current device allowing current to flow responsive to a predetermined relationship between the magnitude of the voltage on the circuit node and the magnitude of a voltage on the capacitor, the charge circuit altering the charge on the capacitor to place a voltage on the capacitor corresponding to the magnitude of the intensity control signal so that the charge on the capacitor can subsequently change by electrons flowing through the emitter until the voltage on the emitter reaches an emission threshold voltage.

2. The driver circuit according to claim 1, further comprising a resistor connected between the capacitor and the emitter to control the rate at which the charge on the capacitor changes as a result of electrons emitted through the emitter.

3. The driver circuit according to claim 2 wherein the values of the capacitor and the resistor are chosen to allow the voltage on the emitter to increase substantially to the emission threshold voltage before the emitter is addressed in the next frame scan.

4. The driver circuit according to claim 1 wherein one plate of the capacitor is connected to an extraction grid held at a constant potential.

5. The driver circuit according to claim 1 wherein the flat panel display has a column line and a row line, wherein the intensity control terminal is coupled to one of the column or row lines and wherein the enable terminal is coupled to the other of the column or row lines.

6. The driver circuit according to claim 1 further comprising a first resistor coupling the enable terminal to the circuit node.

7. The driver circuit of claim 6, further comprising a second resistor connected between the capacitor and the emitter.

8. The driver circuit according to claim 1 wherein the first unidirectional current device comprises a first diode coupled between the intensity control terminal and the circuit node, and wherein the second unidirectional current device comprises a second diode coupled between the circuit node and the capacitor.

9. The driver circuit according to claim 8 wherein the first diode has an anode and a cathode, and wherein the anode is coupled to the intensity control terminal and the cathode is coupled to the circuit node.

10. The driver circuit according to claim 8 wherein the first diode has an anode and a cathode, and wherein the anode is coupled to the intensity control terminal and the cathode is coupled to the circuit node.

11. In a field emission display having at least one emitter associated with a pixel of the display, an extraction grid held at a sufficient potential to allow electrons to be emitted from the emitter, a driver circuit for driving the emitter, comprising:

a capacitor connected between the extraction grid and the emitter; and a charge circuit having a charge terminal connected to the capacitor, the charge circuit for applying a selected voltage level at the charge terminal to allow the extraction grid to charge the capacitor, the selected voltage level corresponding to an intensity level of the associated pixel, the charge circuit including a first diode connected between a column line and a common node;

a second diode connected between the common node and the charge terminal; and a resistor connected between a row line and the common node.

12. The driver circuit according to claim 11, further comprising a second resistor connected between the charge terminal and the emitter for providing a discharge path for the capacitor.

13. The driver circuit according to claim 11, further comprising a third diode connected in series between the column line and the first diode.

14. The driver circuit according to claim 11, further comprising:

a third diode connected in series between the column line and the first diode; and a fourth diode connected in series between the second node and the first node.

15. In a flat panel display having at least one emitter associated with a pixel of the display, an extraction grid, a driver circuit for driving the emitter, comprising:

a capacitor connected to the emitter; and a charge circuit connected between a row line and a column line, the charge circuit having an intensity control terminal coupled to one of the row or column lines and an enable terminal coupled to the other of row or column lines, the charge circuit including a first unidirectional current device coupled between the intensity control terminal and a circuit node to which the enable terminal is coupled, and a second unidirectional current device coupled between the circuit node and the capacitor, the first unidirectional current device allowing current to flow responsive to a predetermined relationship between the magnitude of the intensity control signal and the magnitude of a voltage on the circuit node, the second unidirectional current device allowing current to flow responsive to a predetermined relationship between the magnitude of the voltage on the circuit node and the magnitude of a voltage on the capacitor.

16. The driver circuit according to claim 15, further comprising a resistor connected between the capacitor and the emitter for providing a discharge path for the capacitor.

17. The driver circuit according to claim 16 wherein the values of the capacitor and the resistor are chosen to allow the voltage level across the capacitor to decrease substantially to the emission threshold voltage of the emitter before the emitter is addressed in the next frame scan.

18. The driver circuit according to claim 15 wherein the first unidirectional current device comprises a first diode coupled between the intensity control terminal and the circuit node, and wherein the second unidirectional current device comprises a second diode coupled between the circuit node and the capacitor.

19. The driver circuit according to claim 15 further comprising a first resistor coupling the enable terminal to the circuit node.

20. The driver circuit of claim 19, further comprising a second resistor connected between the capacitor and the emitter for providing a discharge path to the capacitor.

21. The driver circuit according to claim 15 wherein the capacitor is coupled between the emitter and the extraction grid.

* * * * *

UNITED STATES PATENT AND TRADEMARK OFFICE

CERTIFICATE OF CORRECTION

PATENT NO. : 5,742,267
DATED : April 21, 1998
INVENTOR(S) : Dean Wilkinson

It is certified that error appears in the above-identified patent and that said Letters Patent is hereby corrected as shown below:

Column 1,
Line 3, add a new section under the title

-- STATEMENT AS TO GOVERNMENT RIGHTS

This invention was made with United States Government support under Contract No. DABT63-93-C-0025 awarded by the Advanced Research Projects Agency (ARPA). The United States Government has certain rights in this invention. --

Signed and Sealed this

Eleventh Day of December, 2001

*Attest:*

Nicholas P. Godici

*Attesting Officer*

NICHOLAS P. GODICI
*Acting Director of the United States Patent and Trademark Office*